US007424815B1

(12) United States Patent
Pagnoncelli

(10) Patent No.: US 7,424,815 B1
(45) Date of Patent: Sep. 16, 2008

(54) REPROGRAMMABLE LOCK

(75) Inventor: Marco Pagnoncelli, Desio (IT)

(73) Assignee: Giussani Techniques S.p.A., Desio (MI) (IT)

( * ) Notice: Subject to any disclaimer, the term of this patent is extended or adjusted under 35 U.S.C. 154(b) by 0 days.

(21) Appl. No.: 11/808,626

(22) Filed: Jun. 12, 2007

(51) Int. Cl.
*E05B 29/06* (2006.01)

(52) U.S. Cl. ..... 70/340; 70/383; 70/421; 70/492; 70/495

(58) Field of Classification Search ..... 70/337–343, 70/368, 382–385, 417, 421, 492–495
See application file for complete search history.

(56) References Cited

U.S. PATENT DOCUMENTS 3,667,262 A * 6/1972 Hill ..... 70/384
3,990,282 A * 11/1976 Sorum ..... 70/495
3,999,413 A * 12/1976 Raymond et al. ..... 70/495
4,376,382 A * 3/1983 Raymond et al. ..... 70/338
4,712,399 A * 12/1987 Mattossovich ..... 70/495
4,729,231 A * 3/1988 Wu ..... 70/383
4,966,021 A * 10/1990 Boag ..... 70/383
5,235,832 A * 8/1993 Lux et al. ..... 70/368
6,119,495 A * 9/2000 Loreti ..... 70/340
6,755,063 B2 * 6/2004 Takadama ..... 70/495
6,968,717 B2 * 11/2005 Suzuki et al. ..... 70/492
7,114,357 B2 * 10/2006 Armstrong et al. ..... 70/492
2005/0217330 A1 * 10/2005 Chong et al. ..... 70/492
2006/0117822 A1 * 6/2006 Boesel et al. ..... 70/495
2006/0260371 A1 * 11/2006 Williams ..... 70/493
2007/0101782 A1 * 5/2007 Shen ..... 70/495

* cited by examiner

*Primary Examiner*—Lloyd A Gall
(74) *Attorney, Agent, or Firm*—Young & Thompson

(57) ABSTRACT

A reprogrammable lock comprises a rotor (2) mounted rotatably inside a stator (1). In the rotor (2) are mounted key reading plates (3) to read the coding profile (8*b*, 9*b*) of a user/programming key (8, 9), locking plates (4) that can couple with the key reading plates (3) and are adapted to block rotation of the rotor (2) with respect to the stator (1), two lateral inserts (6) integral with the locking plates (4) and provided with an arched surface (6*b*) adapted to slide on the inner surface of the stator (1), and a rotation stopping plate (10) free from the locking plates (4) to block rotation of the rotor (2) with respect to the stator (1).

13 Claims, 7 Drawing Sheets

FIG. 2
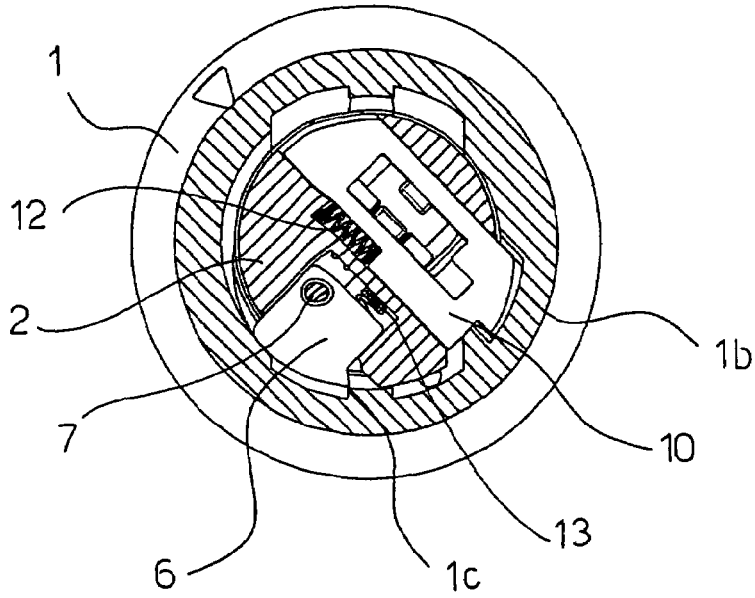
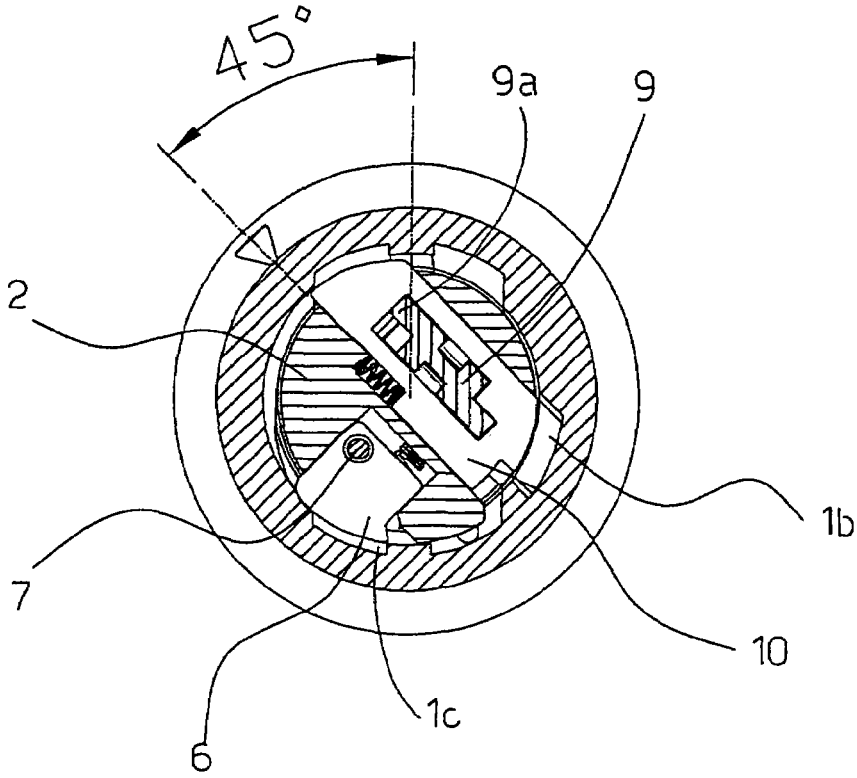
FIG. 3

FIG. 2A
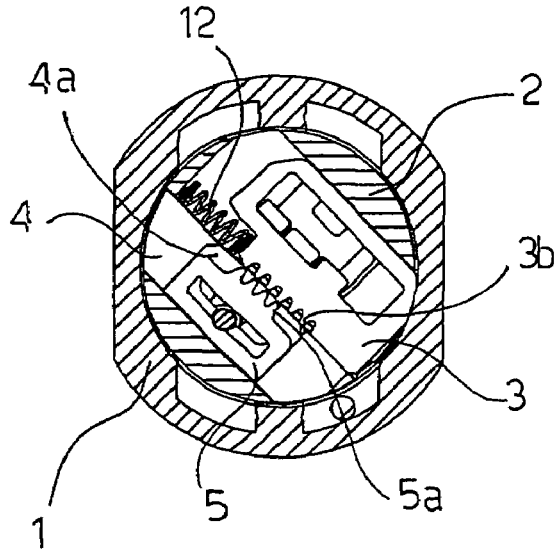
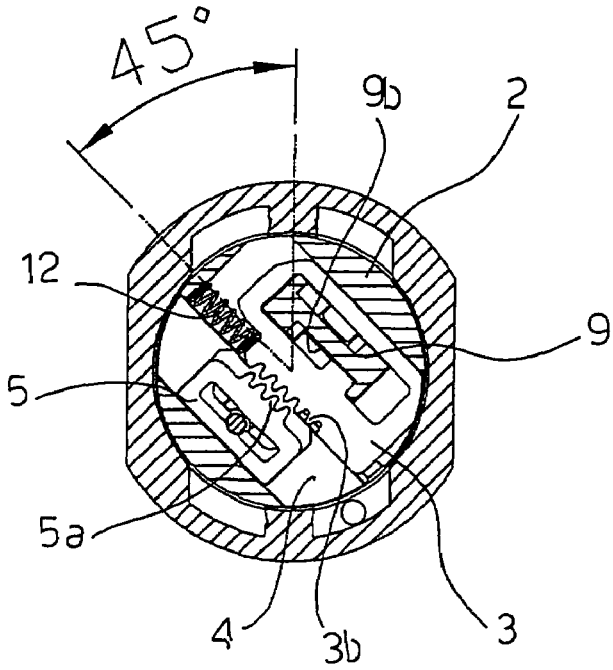
FIG. 3A

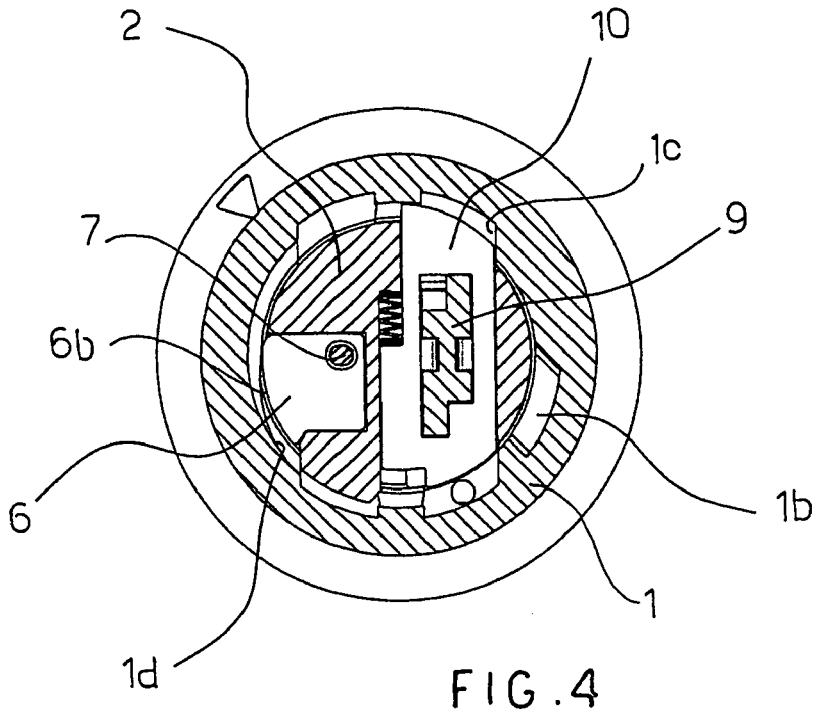
FIG. 4
FIG. 5
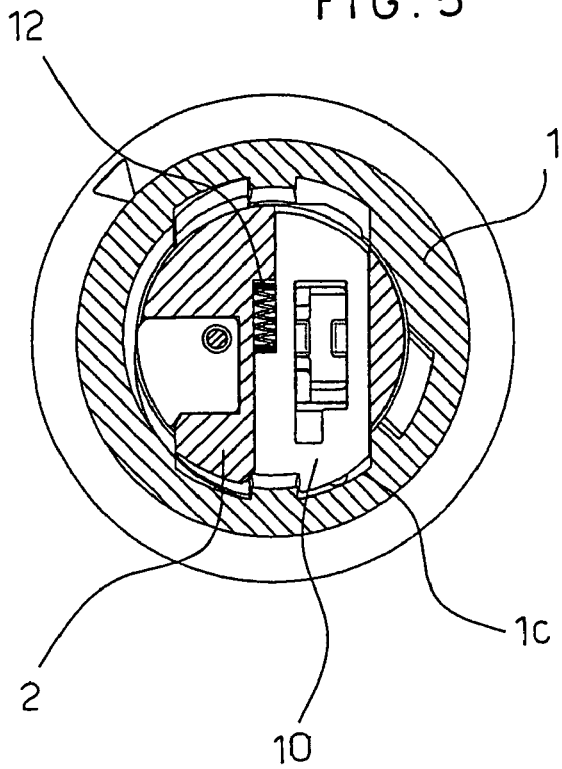

FIG. 4A
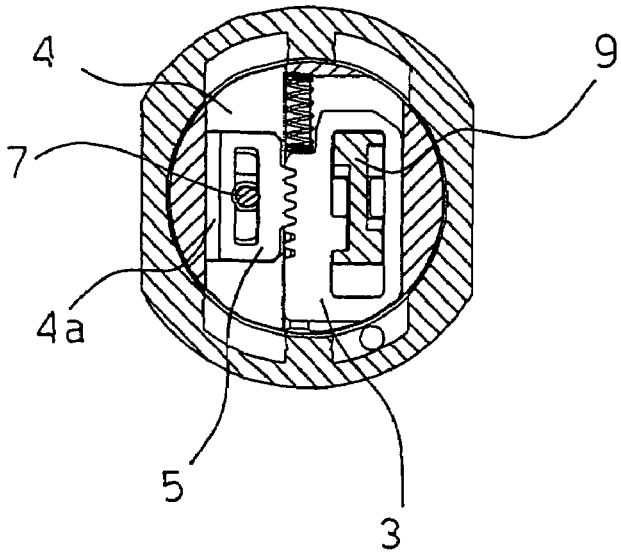
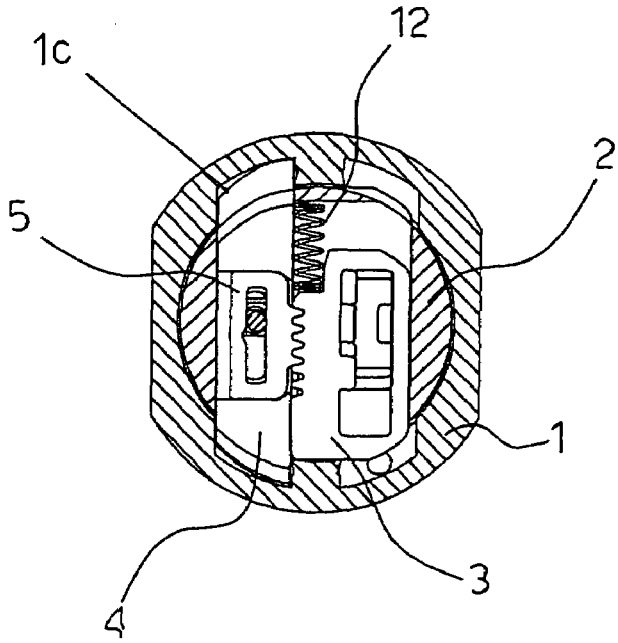
FIG. 5A

FIG. 6
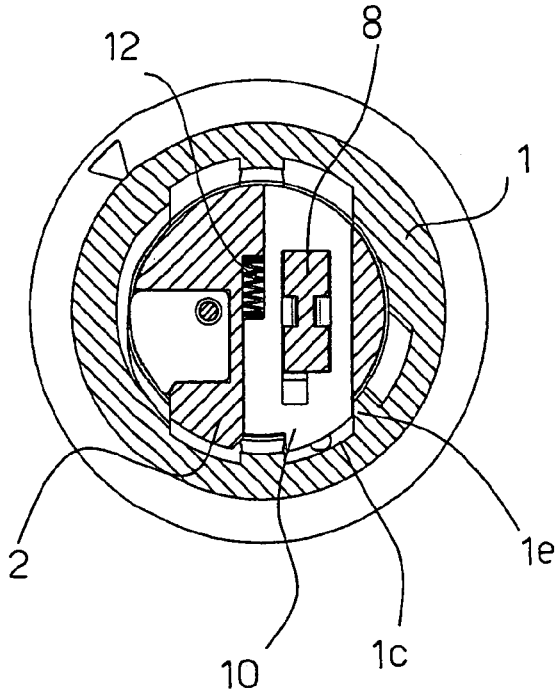
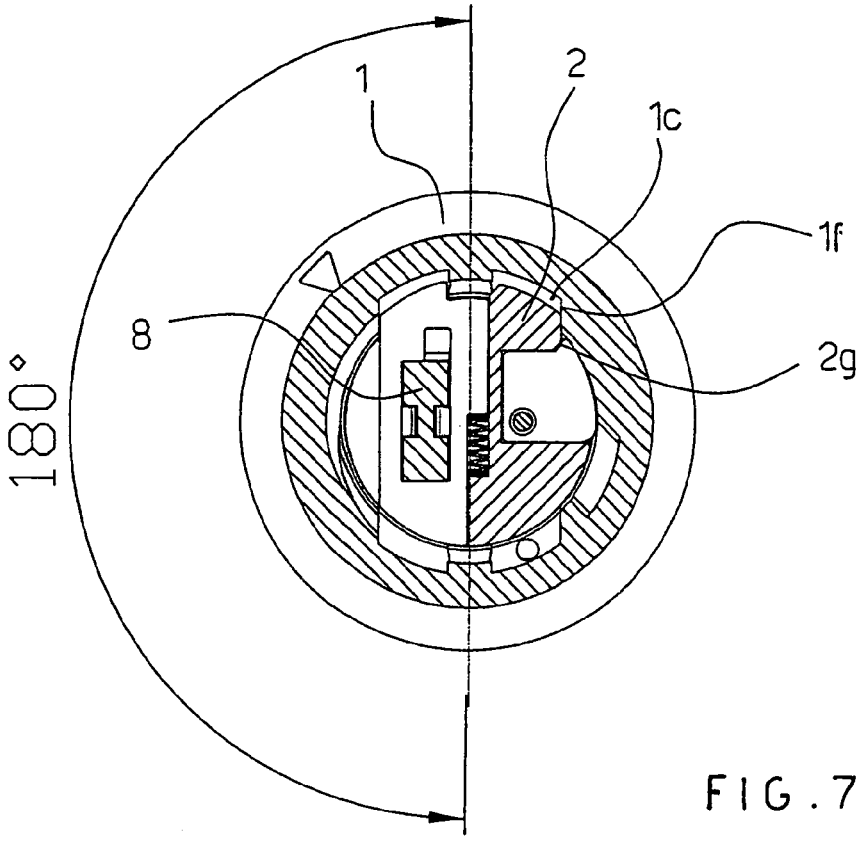
FIG. 7

FIG. 6A
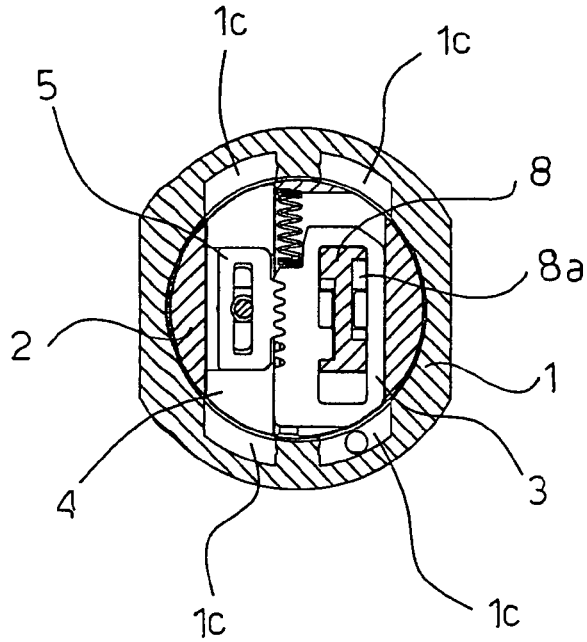
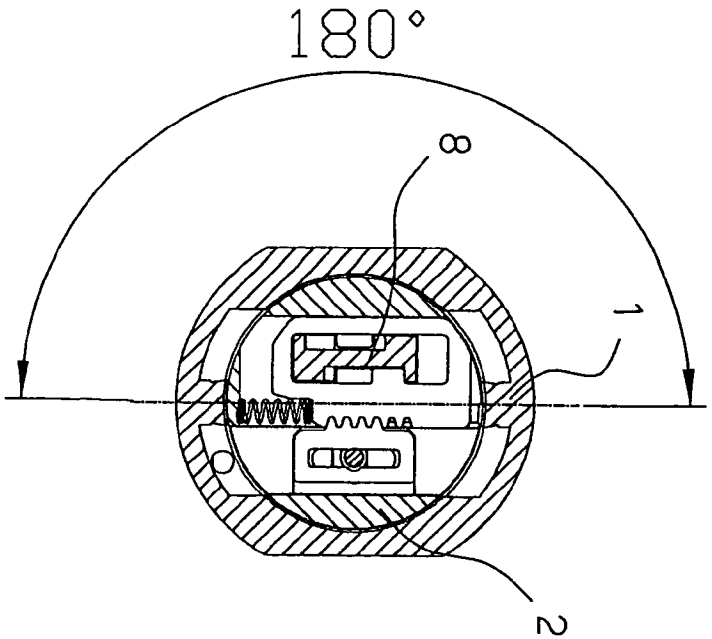
FIG. 7A

REPROGRAMMABLE LOCK

BACKGROUND OF THE INVENTION

The present invention refers to a reprogrammable lock which makes it possible, through rotation of the rotor by means of special reprogrammable keys, to modify the key reading mechanism, thus allowing the lock to operate with keys which have different codes from those used previously and thus preventing the latter from operating the lock.

DESCRIPTION OF THE RELATED ART

Reprogrammable locks are known to the art which in any case present some drawbacks, such as for example structural complexity, difficult industrial production, complicated reprogramming operations, and poor safety and reliability.

SUMMARY OF THE INVENTION

A first object of this invention is to produce a reprogrammable lock that can be produced industrially.

Another object of the invention is to produce a reprogrammable lock that has particular features of mechanical strength and resistance to attempts at picking.

Another object is to provide a lock that can be reprogrammed with rapid, safe operations by the user.

Yet another object of the invention is to produce a reprogrammable lock that can be programmed only by those holding special programming keys.

The reprogrammable lock according to the invention comprises:

- a stator in the form of a hollow cylinder,
- a rotor in the form of a cylindrical block mounted rotatably inside the stator, and
- a locking and programming mechanism disposed inside the rotor.

The locking and programming mechanism comprises:

- a plurality of key reading plates disposed transversally inside the rotor and provided with slots disposed in register with each other to allow the passage of a user or programming key whose coding profile defines the movement of said key-reading plates,
- a plurality of locking plates mounted transversally in said rotor and provided with an end that protrudes outward from the rotor to engage in a cavity defined inside said stator so as to block rotation of the rotor with respect to the stator, said locking plates being able to couple with said key-reading plates so as to be able to be moved into an unlocking position to allow rotation of the rotor with respect to the stator,
- at least two lateral inserts destined to be disposed transversally in said rotor, integral with the locking plates and provided with an arched surface adapted to slide on the inner surface of the stator, and
- a rotation stop plate disposed transversally inside said rotor and provided with a slot disposed in register with the slots of said key reading plates to allow the passage of the key, and having one end that protrudes outward from the rotor to engage in a cavity defined inside said stator so as to block rotation of the rotor with respect to the stator.

BRIEF DESCRIPTION OF THE DRAWINGS

Further characteristics of the invention will be made clearer by the detailed description that follows, referring to a purely exemplifying and therefore non limiting embodiment thereof, illustrated in the appended drawings, in which:

FIGS. 2 and 2A are two cross sectional views of the assembled lock according to the invention, taken respectively along the plane of a rotation stopping plate and of a key reading plate, in which the lock is in the initial state as supplied;

FIGS. 3 and 3A are two views like FIGS. 2 and 2A, in which the programming key has been inserted into the lock;

FIGS. 4 and 4A are two views like FIGS. 2 and 2A, in which the rotor has been turned 45° to carry out programming of the lock;

FIGS. 5 and 5A are two views like FIGS. 2 and 2A, in which the programming key has been removed once programming has been carried out;

FIGS. 6 and 6A are two views like FIGS. 2 and 2A, in which the user key has been inserted into the lock;

FIGS. 7 and 7A are two views like FIGS. 2 and 2A, in which the rotor has been rotated 180° with respect to the situation illustrated in FIGS. 6 and 6A.

DESCRIPTION OF THE PREFERRED EMBODIMENTS

Figure 1:
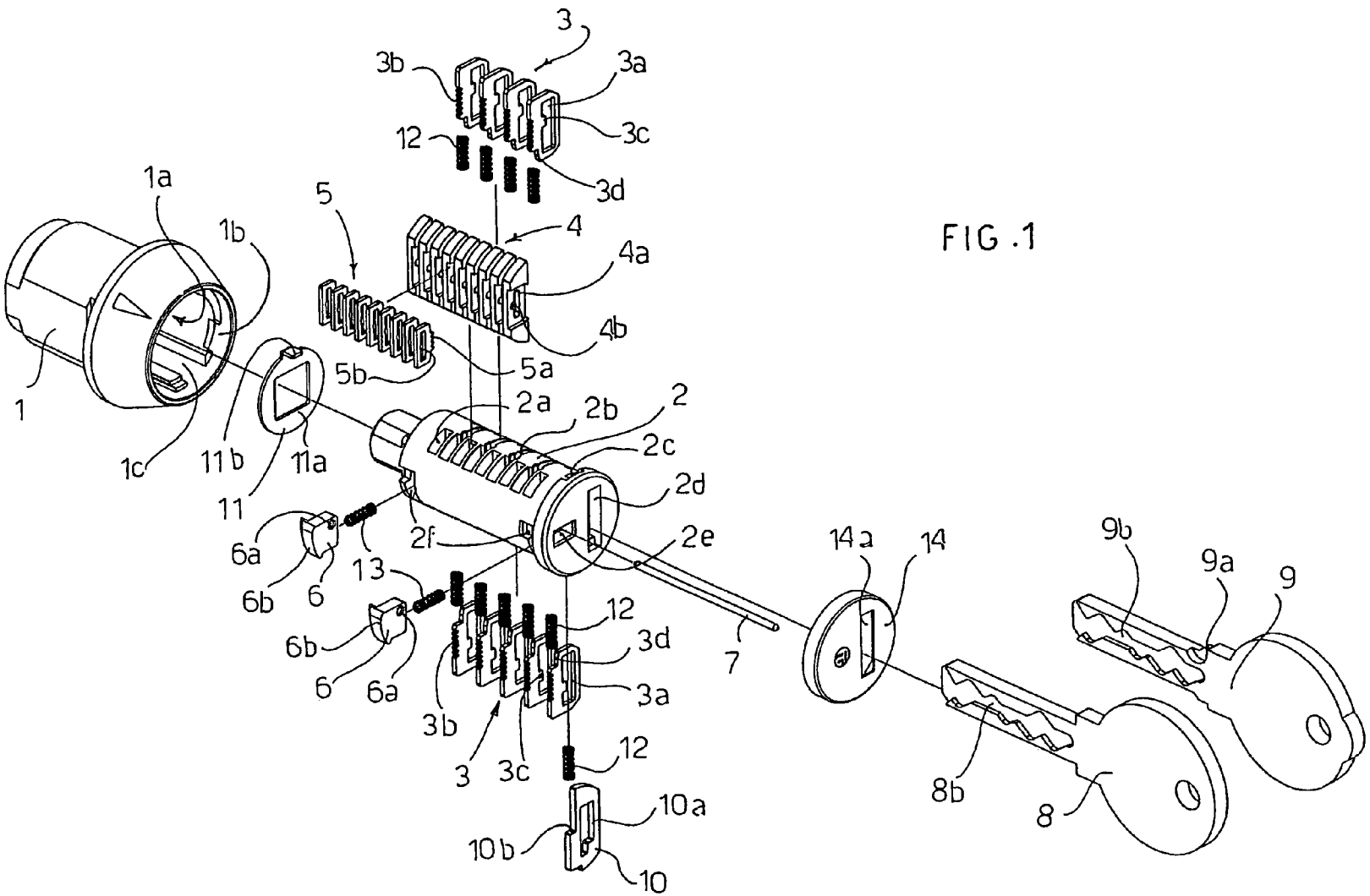
FIG. 1 is a perspective view, illustrating all the members of the reprogrammable lock according to the invention exploded.

A reprogrammable lock according to the invention is described with the aid of the figures. FIG. 1 shows the reprogrammable lock according to the invention, with all its details exploded.

The lock comprises a stator 1, with a substantially hollow cylindrical shape, provided with an axial hole 1*a* to contain a rotor 2 in the form of a small cylinder that can rotate inside the stator 1.

In the inside surface of the stator 1, inside the hole 1*a*, cavities 1*c* (four like opposed cavities) and 1*b* are defined, adapted to be used to house the members of the lock mounted in the rotor 2 as will be described hereunder.

The rotor 2 is composed of a cylindrical body wherein are formed cavities which contain the various members of the reprogramming mechanism of the lock. For this purpose transverse cavities 2*b* are formed on the side surface of the rotor 2, adapted to receive respective key reading plates 3 and respective springs 12 which bias the key reading plates 3 radially outward. To be precise, a first group of four key reading plates 3 is inserted in a first row of transverse slots 2*b* and a second group of five key reading plates 3 is inserted in a second row of transverse slots 2*a* disposed in an opposite position to the first row.

Again in the lateral surface of the rotor 2, near the ends thereof, two transverse seats 2*f* are formed, adapted to house lateral inserts 6 with respective springs 13 which bias the lateral inserts 6 radially outward.

Again in the lateral surface of the rotor 2, between the two rows of seats 2*b*, there is a row of transverse seats 2*a* adapted to receive respective locking plates 4. To be precise, nine locking plates 4 are provided, that is to say a number equal to the number of key reading plates 3. Each locking plate 4 receives a respective programming plate 5 adapted to couple with a respective key reading plate 3, as will be described hereunder.

In the lateral surface of the rotor 2, near the front end thereof, a last transverse cavity 2*c* is provided, which serves to contain a rotation stop plate 10 and the spring thereof 12 which biases it radially outward.

In the front part of the rotor 2 there is a first longitudinal cavity 2*d* which serves to receive a user key 8 or a programming key 9, as will be described hereunder.

Again in the front part of the rotor 2 there is a second longitudinal cavity 2*e* which serves for insertion of a pin 7 which is used to join the locking plates 4, the programming plates 5, the lateral inserts 6 and the respective springs 13 in a single body.

The key reading plates 3 have a shaped cavity 3*a* with a protruding tooth 3*c* which serves for the passage and reading of the coding profile 8*b*, 9*b* present on the keys 8, 9.

The outer part of each key reading plate 3 has teeth 3*b* which couple with matching teeth 5*a* provided on the outer part of each programming plate 5. In this manner, the key reading plates 3 and the programming plates 5 form a single group, thus determining coding. The key reading plates 3 never protrude beyond the edge of the outer diameter of the rotor 2, and their function is solely that of adapting to the coding profile 8*b*, 9*b* produced on the key 8, 9, without interfering with rotation of the rotor 2 with respect to the stator 1.

The bottom part of each key reading plate 3 has an undercut seat 3*d* where the respective spring 12 is housed.

The locking plates 4 have a seat 4*a* which serves to contain the programming plates 5. In the locking plates 4 there is furthermore a slot or hole 4*b* which serves for passage of the pin 7. The locking plates 4 have one end which protrudes outward from the rotor 2 entering into the cavity 1*c* of the stator 1 to block rotation of the rotor 2 if an unauthorized person attempts to open the lock with a key with different coding from that of programming or use.

The programming plates 5 have teeth 5*a* which engage with the teeth 3*b* of the key reading plates 3 which determine coding of the user key during programming. The programming plates 5 have a slot or hole 5*b* to receive the pin 7 so as to form a single body integral with the locking plates 4 and key reading plates 3.

The lateral inserts 6 have an arched surface 6*b* adapted to slide on the inside surface of the stator 1. The inside surface of the stator acts as a cam, whereas the arched surface 6*b* of the lateral inserts 6 acts as a cam follower.

The lateral inserts 6 further comprise a hole 6*a* for insertion of the pin 7 and another blind hole (not shown) which contains the respective springs 13. The lateral inserts 6 thus serve to move the programming plates 5 integrally with the key reading plates 3.

The front rotation stopping plate 10 has a seat 10*a* adapted to allow the user key 8 or the programming key 9 to pass therein. The end of the rotation stopping plate 10 protrudes from the rotor 2 to engage partially in the cavity 1*b* of the stator 1 and block rotation of the rotor. The rotation stopping plate 10 is also used as an anti-picking plate, in that it is made of a material that withstands attempts at drilling or forcing with blunt instruments. In the outer part of the rotation stopping plate 10 there is a relief cut 10*b* which provides a housing for the spring 12.

A rotation limiter 11 consisting of a circular plate which has a square hole 11*a* and a tooth 11*b* is disposed in the rear part of the rotor 2. The rotation limiter 11 is applied in the rear part of the rotor 2 to limit rotation of the rotor during 90° opening of the lock.

In the front part of the rotor 2 is disposed a hood 14 which has in its front part a cavity 14*a* destined to be disposed in register with the cavity 2*d* for passage of the user key 8 or of the programming key 9.

The lock according to the invention is supplied with two keys 8 and 9, with coding profiles 8*b* and 9*b* that may be identical to each other. These are reversible keys with a two-track inner profile. One is the programming key 9 and the other is the user key 8.

The programming key 9 differs from the user key 8 in that it has two teeth 9*a* and relative relief cuts formed at the end of the shank of the coding plane 9*b*, at the shoulder of the key. The teeth 9*a* of the programming key serve to operate the rotation stopping plate 10, which is the first plate in the rotor 2, in the direction of insertion of the key.

Operation of the lock according to the invention, which takes place by means of a sequence of operations, is described hereunder with reference to FIGS. 2-7A.

The assembled lock, in the state in which it is supplied to the client, is as illustrated in FIGS. 2 and 2A. As shown in FIG. 2, the rotation stopping plate 10 is locked in the cavity 1*b* of the stator 1, preventing rotation of the rotor 2 with respect to the stator 1 in both a clockwise and a counterclockwise direction. The lateral insert 6 is disposed in the cavity 1*c* of the stator 1 and prevents rotation of the rotor only in a counterclockwise direction. As shown in FIG. 2A, the teeth 3*b* of the key reading plates 3 are opposed to the teeth 5*a* of the programming plates 5, that is to say they are misaligned with respect to the grooves defined by the teeth 5*a* of the programming plates 5.

This condition is called the programming condition because in this position the lock must be programmed, giving the lock a missing characteristic, namely the ability to read only a key coding, so that it is used univocally by the owner of the programming key. From this position, the special programming key 9 must be inserted into the slot 2*d* of the rotor 2 in order to be able to program the lock.

As shown in FIG. 3, once the programming key 9 has been inserted into the lock, the teeth 9*a* of the programming key 9 move the rotation stopping plate 10 from the cavity 1*b* of the stator 1, so that the whole rotor assembly 2 can subsequently rotate to the position in which programming has been accomplished, that is, 45° clockwise with reference to the figures. Before proceeding with rotation of the rotor 2, it should be noted that the rotor 2 is unable to rotate counterclockwise because of the lateral insert 6 which abuts against a plane of the cavity 1*c* of the stator 1, as shown in FIGS. 2 and 3.

Furthermore, with insertion of the programming key 9, FIG. 3A the key reading plates 3, thanks to the bias of the relative springs 12, come to rest on the coding profile 9*b* of the programming key 9, correct alignment between the teeth 3*b* of key reading plates 3 and the grooves defined between the teeth 5*a* of the programming plates 5 thus taking place.

As shown in FIG. 4, during programming (45° rotation of the rotor 2) the curved surfaces 6*b* of the lateral inserts 6 slide along a curve 1*d* defined in the inner surface of the stator 1 which is eccentric to the axis of the lock. Consequently the lateral inserts 6 move towards the centre of the rotor 2.

During this operation, the lateral inserts 6, by means of the pin 7, pull the programming plates 5 (FIG. 4A) inserted in the seat 4*a* formed in the locking plates 4, until they couple with the key reading plates 3. In this manner, through meshing of the teeth 3*b* and 5*a* of the key reading plates 3 and the programming plates 5, an integral assembly is created between the key reading plates 3, the locking plates 4 and the programming plates 5.

Once programming of the lock is completed, the rotor 2 is unable to continue its rotation beyond 45°, in that, as shown in FIG. 4, the rotation stopping plate 10 abuts against a plane of the cavity 1*c* present in the stator 1.

The next stage will be that of withdrawing the programming key 9 and inserting the user key 8 with coding 8*a* identical to the previous one 9*a*.

As shown in FIGS. 5 and, 5A, in the situation of the lock being closed without the key inserted, it is impossible for the rotor 2 to make any type of rotation. In fact, the rotation stopping plate 10 and the locking plate 4, being part of the integral assembly of plates 3, 4, and 5 previously described, through the bias of their springs 12, position themselves in the cavity 1*c* of the stator 1.

FIGS. 6 and 6A show the situation in which the user key 8 is inserted in the slot 2*d* of the rotor. With reference to FIG. 6A, during this operation the key reading plates 3 rest on the coding profile 8*a* of the key 8. As a result the assembly of plates 3, 4 and 5 moves integrally, aligning itself externally to the outside diameter of the rotor 2, so as to allow 180° rotation thereof, as shown in FIG. 7A.

With reference to FIG. 6, in the same situation, the rotation stopping plate 10, through the spring 12 which biases it, comes to rest on the user key 8, which is lower in its working section than the programming key 9. Because of this the rotation stopping plate 10 is caused to be moved towards the centre of the rotor 2.

This causes alignment of the rotation stopping plate 10 with the rotor 2 in the upper part, whereas in the lower part the rotation stopping plate 10 will abut against an outer wall 1*e* of one of the cavities 1*c* present in the stator 1.

In this condition the rotor can freely rotate 180° clockwise, as shown in FIG. 7.

The rotation stop at 180° is formed at the shoulder of the rotor 2 which abuts against a wall 1*f* of the cavity 1*c*.

In this position, called the "lock open" position, the key 8 can be withdrawn. It should be specified that withdrawal and insertion of the keys 8, 9 is determined by the condition which gives the locking plates 4 the possibility of being able to protrude from the line of the outside diameter of the rotor 2. In fact the codes 8*b* and 9*b* produced on the keys are of different heights, and are read by the key reading plates 3, integral with the locking plates 4 and the programming plates 5. Thus during linear movement of the key 8, 9, a movement of the integral group of plates 3, 4 and 5 is caused which is possible only in the 0° and 180° positions, coinciding with the cavities 1*c* formed in the stator 1.

Moreover, when the user key 8 inserted does not have the same coding as the programming key 9 (typical in attempts at breaking in with the use of forged keys) the no key situation described with reference to FIGS. 5 and 5A is recreated. The differences in coding between the two keys 8 and 9 mean that a part of the locking plates 4 are positioned inside the cavity 1*c* of the stator 1, thus preventing normal operation of the lock.

Numerous variations and modifications of detail within the reach of a person skilled in the art can be made to the present embodiment of the invention without thereby departing from the scope of the invention as set forth in the appended claims.

The invention claimed is:

1. A reprogrammable lock comprising:

a stator (1) in the form of a hollow cylinder, a rotor (2) in the form of a cylindrical block mounted rotatably inside the stator (1), a plurality of key reading plates (3) disposed transversally inside the rotor (2) and provided with slots (3*a*) disposed in register with one another to allow the passage of a user key or a programming key (8, 9) whose coding profile (8*b*, 9*b*) defines the movement of said key reading plates (3), a plurality of locking plates (4) mounted transversally in said rotor (2) and provided with one end which protrudes outward from the rotor (2) to engage in a cavity (1*c*) defined inside said stator (1) so as to block rotation of the rotor (2) with respect to the stator (1), said locking plates (4) being able to couple with said key reading plates (3) so as to be able to be moved into an unlocking position to allow rotation of the rotor with respect to the stator, at least two lateral inserts (6) movable transversally in said rotor (2) together with the locking plates (4), said lateral inserts (6) being provided with an arched surface (6*b*) adapted to slide on the inner surface of the stator (1), and a rotation stopping plate (10) disposed transversally inside said rotor (2) and provided with a slot (10*a*) disposed in register with the slots (3*a*) of said key reading plates to allow the passage of the key (8, 9), said rotation stopping plate (10) being provided with an end which protrudes outward from the rotor (2) to engage in a cavity (1*c*) defined inside said stator (1) so as to block the rotation of the rotor (2) with respect to the stator (1) and being adapted to require the programming key (9) to unlock rotation of the rotor with respect to the stator.

2. A reprogrammable lock according to claim 1, characterised in that each locking plate (4) has a seat (4*a*) adapted to receive a programming plate (5) that can couple with a respective key reading plate (3).

3. A reprogrammable lock plate according to claim 2, characterised in that said locking (4), said programming plates (5) and said lateral inserts (6) have respective holes or slots (4*b*, 5*b*, 6*a*) aligned to receive a pin (7) so as to form an integral assembly.

4. A reprogrammable lock according to claim 2, characterized in that said key reading plates (3) have outer teeth (3*b*) adapted to couple in a clamping relationship with matching outer teeth (5*a*) formed in said programming plates (5).

5. A reprogrammable lock according to claim 1, characterised in that each key reading plate (3) has an undercut seat (3*d*) adapted to receive a spring (12) which is interposed between the key reading plate (3) and the rotor (2).

6. A reprogrammable lock according to claim 1, characterised in that said rotation stopping plate (10) has a relief cut (10*b*) adapted to receive a spring (12) which is interposed between the rotation stopping plate (10) and the rotor (2).

7. A reprogrammable lock according to claim 1, characterised in that each lateral insert (6) has a hole in the wall opposite its arched wall arched surface (6*b*) to receive a spring (13) which is interposed between the lateral insert (6) and the rotor (2).

8. A reprogrammable lock according to claim 1, characterised in that said rotor (2) comprises:

two opposed rows of transverse seats (2*b*) to receive said key reading plates (3), a row of transverse seats (2*a*) to receive said locking plates (4), two transverse seats (2*f*) disposed near the side ends to receive said lateral inserts (6), a transverse seat (2*c*) to receive said rotation stopping plate (10), and a longitudinal slot (2*d*) to allow insertion of the user key or the programming key (8, 9).

9. A reprogrammable lock according to claim 8, characterised in that each locking plate (4) has a seat (4*a*) adapted to receive a programming plate (5) that can couple with a respective one of the key reading plates (3), and said rotor comprises a longitudinal hole or slot (2*e*) adapted to allow the passage of a pin (7) which constrains the locking plates (4), the programming plates (5) and the lateral inserts (6).

10. A reprogrammable lock according to claim 1, characterised in that said stator (1) has in its inner surface four diametrically opposed seats (1*c*) to receive the end of said locking plates (4) and of said rotation stopping plate (10) and a seat (1*b*) cooperable with an arched surface (6*b*) of said lateral inserts (6).

11. A reprogrammable lock according to claim 1 in combination with at least one of the user key and the programming key (8, 9) whose coding profile (8*b*, 9*b*) defines the movement of said key reading plates (3), wherein, the rotation stopping plate (10) allows the passage of the one key (8, 9).

12. A reprogrammable lock according to claim 1 in combination with the programming key (9) whose coding profile (9*b*) defines the movement of said key reading plates (3), wherein, the rotation stopping plate (10) allows the passage of the programming key (9), said rotation stopping plate (10) blocking the rotation of the rotor (2) with respect to the stator (1) and requiring the programming key (9) to unlock rotation of the rotor with respect to the stator.

13. A reprogrammable lock according to claim 1 in combination with at the user key and the programming key (8, 9) whose coding profiles (8*b*, 9*b*) defines the movement of said key reading plates (3), wherein, the rotation stopping plate (10) allows the passage of the user key and the programming key (8, 9), said rotation stopping plate (10) blocking the rotation of the rotor (2) with respect to the stator (1) and requiring the programming key (9) to unlock rotation of the rotor with respect to the stator.

* * * * *